US006362835B1

(12) United States Patent
Urbanus et al.

(10) Patent No.: US 6,362,835 B1
(45) Date of Patent: Mar. 26, 2002

(54) BRIGHTNESS AND CONTRAST CONTROL FOR A DIGITAL PULSE-WIDTH MODULATED DISPLAY SYSTEM

(75) Inventors: Paul M. Urbanus, Dallas; Robert J. Gove, Plano, both of TX (US)

(73) Assignee: Texas Instruments Incorporated, Dallas, TX (US)

( * ) Notice: Subject to any disclaimer, the term of this patent is extended or adjusted under 35 U.S.C. 154(b) by 0 days.

(21) Appl. No.: 08/156,541

(22) Filed: Nov. 23, 1993

(51) Int. Cl.[7] ..... G09G 3/00

(52) U.S. Cl. ..... 345/692; 345/589; 345/63; 345/89

(58) Field of Search ..... 345/148, 77, 94, 345/147, 89, 213, 63, 691, 692, 693, 690, 589, 596

(56) References Cited

U.S. PATENT DOCUMENTS

| | | | | | |
|---|---|---|---|---|---|
| 3,786,481 | A | * | 1/1974 | Hartman | 345/20 |
| 4,195,293 | A | * | 3/1980 | Margolin | 345/197 |
| 4,709,230 | A | * | 11/1987 | Popowski et al. | |
| 4,864,290 | A | * | 9/1989 | Waters | 345/148 |
| 5,061,049 | A | | 10/1991 | Hornbeck | 359/224 |
| 5,091,722 | A | * | 2/1992 | Kitajima et al. | 345/213 |
| 5,187,578 | A | * | 2/1993 | Kohgami et al. | 345/148 |
| 5,196,839 | A | * | 3/1993 | Johary et al. | 345/148 |
| 5,278,652 | A | | 1/1994 | Urbanus et al. | 358/160 |
| 5,317,334 | A | * | 5/1994 | Sano | 345/148 |

FOREIGN PATENT DOCUMENTS

| | | | | |
|---|---|---|---|---|
| EP | A-0 467 048 | | 1/1992 | |
| JP | 2212881 | * | 8/1990 | 345/147 |
| JP | 4211294 | * | 8/1992 | 345/148 |
| WO | WO-A-92 12506 | | 7/1992 | |

* cited by examiner

*Primary Examiner*—Lun-Yi Lao
(74) *Attorney, Agent, or Firm*—Charles A. Brill; Wade James Brady, III; Frederick J. Telecky, Jr.

(57) ABSTRACT

A method and system for adjusting the brightness and contrast of a digital pulse-width modulated display without scaling the input image data. Brightness is adjusted by changing the duty cycle of a displayed pixel either by altering the bit display durations, or by turning the pixel on during blanking periods 36. The contrast ratio may be altered by changing the display duration of at least one of the MSBs differently than the display duration of at least one of the LSBs. Contrast may be increased by extending the MSB display periods 50 and shortening the LSB display periods 52. Contrast may be decreased by shortening the MSB display periods 56 and extending the LSB display periods 58. The color tint of the displayed image may be altered by individually changing the brightness of the constituent colors.

9 Claims, 1 Drawing Sheet

BRIGHTNESS AND CONTRAST CONTROL FOR A DIGITAL PULSE-WIDTH MODULATED DISPLAY SYSTEM

FIELD OF THE INVENTION

This invention relates to the field of visual display systems, more particularly, to digital pulse-width modulated display systems.

BACKGROUND OF THE INVENTION

Display systems have long given viewers the capability to adjust display characteristics in order to adapt to ambient conditions, adjust for poor quality input signals, compensate for an aging display device, or to suit personal preferences. Two of the primary means for adjustment have been the brightness control and the contrast control.

The brightness control theoretically adjusts the brightness or intensity of the display by changing the amount of light emitted, reflected, or transmitted by the display. The contrast control adjusts the brightness ratio between light and dark areas of the screen. Typically both the brightness and contrast adjustments are implemented by changing either the gain or offset characteristics, or both the gain and offset characteristics, of the image signal path.

Implementation of brightness and contrast controls in an all digital image display system can be difficult. Typically this involves additional hardware such as multipliers or lookup tables to scale the image data. Software can also be used to scale the image data, but this requires additional processing capability.

SUMMARY OF THE INVENTION

A method and system of adjusting the intensity of a pulse-width modulated digital display pixel, wherein each pixel is represented by a binary intensity word, and displayed sequentially for a duration dependent on the binary weight of the bit is disclosed. According to one embodiment of the disclosed invention, the display duration of each bit of the intensity word is altered to either increase the duty cycle of the pixel, resulting in increased pixel brightness, or to decrease the duty cycle of the pixel, resulting in decreased pixel brightness. To adjust the contrast ratio of a digital display, the duration of some bits is increased while the duration of other bits is decreased. The disclosed method and system have the advantage of being inexpensive and easy to implement.

DETAILED DESCRIPTION OF THE PREFERRED EMBODIMENTS

The invention taught herein may be applied to any display system that uses pulse-width modulation to control the intensity of an image. For the purposes of explanation the following discussion will focus on the digital micromirror device (DMD) spatial light modulator (SLM). DMDs may be fabricated in several styles such as cantilever beam, flexure beam and torsion beam. This disclosure will concentrate on torsion beam DMDs as explained in U.S. Pat. No. 5,061,049, "Spatial Light Modulator and Method", assigned to Texas Instruments Incorporated. Other display devices could be used including liquid crystal device (LCD) arrays and light emitting device (LED) arrays.

Each element of a digital display is only capable of producing two intensity levels, on and off. Pulse-width modulation is used in order to produce other levels of brightness. Pulse-width modulation alters the duty cycle of each pixel according to the desired intensity of the pixel. The viewer's eye integrates the light from each pixel over time providing the different duty cycles with an appearance of different intensity levels. In a pulse-width modulation display system, the duty cycle for each pixel is assigned a n-bit intensity word. The significance of each bit determines how long the bit will be displayed. For example, bit n is displayed twice as long as bit n−1. The length of time a given bit is displayed is determined by the bit's weight value, the frame period and the maximum duty cycle. Typically, all bits of one weight value are displayed simultaneously, followed by all bits of the next weight value.

Figure 1:
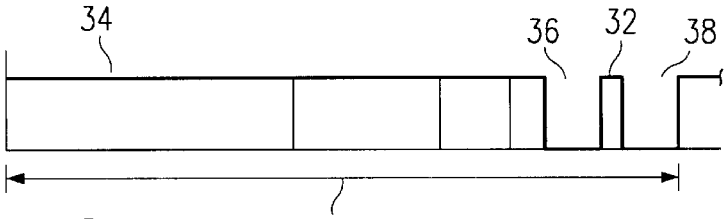
FIG. 1 is one example of a timeline for a typical 5-bit digital display using pulse-width modulation.

FIG. 1 shows a typical timeline for one frame of a 5-bit digital pulse-width modulated display system. In FIG. 1, the horizontal axis represents time and the vertical axis represents the pixel intensity, either on or off. A 5 bit system allows 32 unique intensities to be displayed. The selection of a 5-bit data word for the described embodiments is arbitrary, and was chosen for illustrative purposes. The invention may be implemented on display systems with any size data word having at least two bits. Typically an 8-bit data word is used for each color being displayed.

Frame period 30 is the time period required to load and display one 5-bit word of data on a DMD based display system. Bit period 32 is the display period for the LSB, bit 0, and bit period 34 is the display period for the MSB, bit 4. Although FIGS. 1 through 5 show the pixel being turned on for each bit period, this is done for purposes of illustration only, each bit period could be on or off independent of any other bit period. Because each element of a DMD contains a memory cell, DMDs are capable of being loaded with one bit while another bit is being displayed. This increases the maximum duty cycle of a DMD based display and reduces the bandwidth requirements of the DMD interface. When the display period for a bit is less than the time required to load the array, blanking periods are used. During a blanking period, each pixel is turned off while data for the next weight value is written to the array. DMD arrays are typically designed to allow large groups of the mirrors to be rapidly set or cleared by writing a single data word to the array. This operation is called a block set or block clear.

FIG. 1 shows two blanking periods 36, and 38 during which the pixel is turned off. The duration of these periods is typically equal to the time required to load a frame of data into the display and may not be required on all display systems. Other display systems may have many more periods of blanking for each pixel. For example, on many LCD and LED systems, data is scanned into the display on a row by row basis one bit at a time. In this case the pixel is turned off between each bit period while the remaining rows of the display are driven.

The maximum brightness of an image is determined by how much light can be emitted, reflected, or transmitted by the display device in a given period of time. Brightness may be increased by increasing the duty cycle of the pixel. Prior art solutions relied on scaling the image data word thereby changing the value of the data word. A means to scale the data such as a multiplier or lookup table is usually required by the prior art solutions. This invention discloses a method of altering the brightness of a display that does not require scaling the image data. The disclosed method relies on altering the duty cycle for a pixel without changing the data word. One implementation is to increase the bit periods for each bit displayed. However, display systems are typically designed to maximize the duty cycle of a full-scale data value and the bit periods cannot be further increased without reducing the frame rate.

Figure 2:
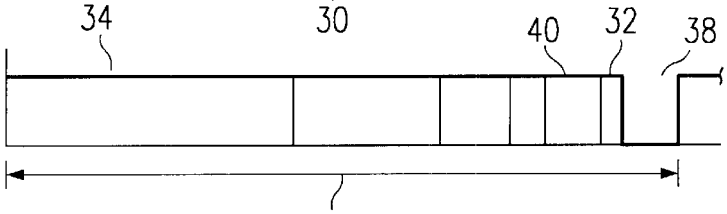
FIG. 2 is one example of a timeline for a typical 5-bit digital display having increased brightness according to a first embodiment of the present invention.

Blanking periods limit the duty cycle of each pixel in the display and therefore lower the maximum brightness capability of the display. According to one embodiment of this invention, display brightness may be increased by changing one or more of the block clear periods to block set periods. FIG. 2 shows the timeline of a typical 5-bit display having increased brightness according to a first embodiment of this invention. As shown, one block clear period 40 is now a block set time. If still greater brightness is required, the second block clear period 38 could be changed to a block set period. This method of increasing the brightness of a display has the disadvantage of being a rather large step increase in brightness, and the increase is not related to the desired brightness. To offset the large step increase, the weighted bit periods could be simultaneously reduced to achieve a more gradual increase in brightness. The method taught may also reduce the contrast ratio of the display. In color systems changing block resets to block sets may also tend to washout the true color of the image. However, despite the disadvantages, there are applications where increased brightness may be desirable to the viewer even if some artifacts are introduced.

Figure 3:
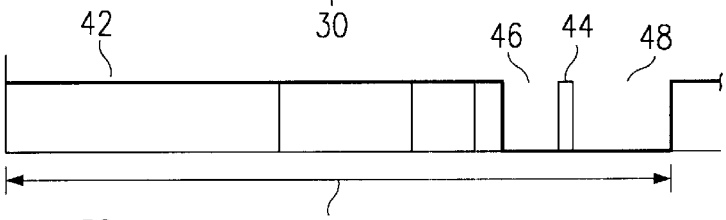
FIG. 3 is one example of a timeline for a typical 5-bit digital display having decreased brightness according to a second embodiment of the present invention.

In order to decrease the brightness of an image, the display period for one or more bits may be reduced. FIG. 3 shows a typical 5-bit timeline according to a second embodiment of the present invention wherein the display period for each bit has been reduced by an amount equal to one-half LSB. Note that in FIG. 3, block clear period 48 is now longer than the time required to load the display. While FIG. 3 shows each bit reduced by the same amount, different reductions could be applied to each bit to achieve a similar effect. For example, in some applications, only the period of the LSB would be reduced. Other applications may reduce each period by a different amount. One method is to proportionally reduce each period to maintain the relative durations of each weight. When a bit period is reduced to less than the response time of the SLM, the bit is not displayed. Depending on the method used to reduce the periods, artifacts may be created.

Up to this point the examples have focused on a display system with a single intensity word, such as a monochrome display. The invention could also be applied to systems having at least two data words such as color systems having a separate data word for each color. When applied to color systems, the manipulation of the data word could be done equally to each color word, or certain colors could be manipulated differently to alter the tone of the displayed image.

Another display characteristic that may be controlled using the instant invention is the contrast ratio. In order to change the contrast ratio, some bit periods are increased while some are decreased. If the viewer desires to increase the contrast, the bit period of one or more of the MSBs is increased while the periods of one or more of the LSBs is decreased. This results in both increasing the brightness of the brighter pixels and decreasing the brightness of the lower intensity pixels. For example, if the MSB period is increased, the brightest half of all possible intensity words will increase. If the LSB period is decrease, then all odd intensity words will decrease. The decrease of the dimmest values will be the most noticeable.

Figure 4:
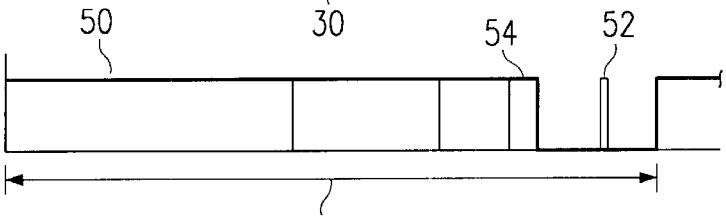
FIG. 4 is one example of a timeline for a typical 5-bit digital display having increased contrast according to a third embodiment of the present invention.

FIG. 4 shows a typical 5-bit timeline for a system with increased contrast according to a third embodiment of this invention. In FIG. 4, the MSB period 50 has been increased while the two LSB bit periods 52 and 54 have been decreased. An alternative would be to simply decrease the bit periods of one or more of the LSBs. The bit periods of the MSBs could not be increased without decreasing the LSBs unless the system was designed to include extra blanking time within each frame.

Figure 5:
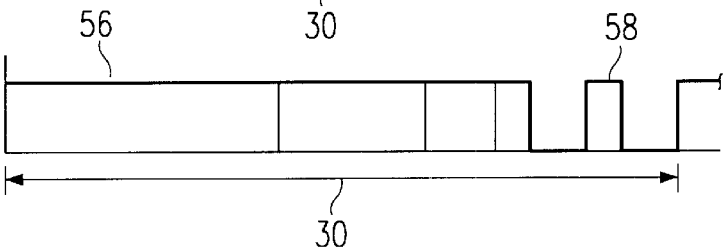
FIG. 5 is one example of a timeline for a typical 5-bit digital display having decreased contrast according to a fourth embodiment of the present invention.

To decrease the contrast ratio the opposite is done. Bit periods for the MSBs are decreased while the bit periods of the LSBs are increased. This decreases the brightness of the brightest pixels and increases the brightness of the dimmest pixels. Once again the MSBs could be decreased without increasing the LSBs in order to achieve the same effect. FIG. 5 shows a timeline for a system with decreased contrast according to a fourth embodiment of the present invention. In FIG. 5, the MSB period 56 has been decreased while the LSB period 58 has been increased.

Figure 6:
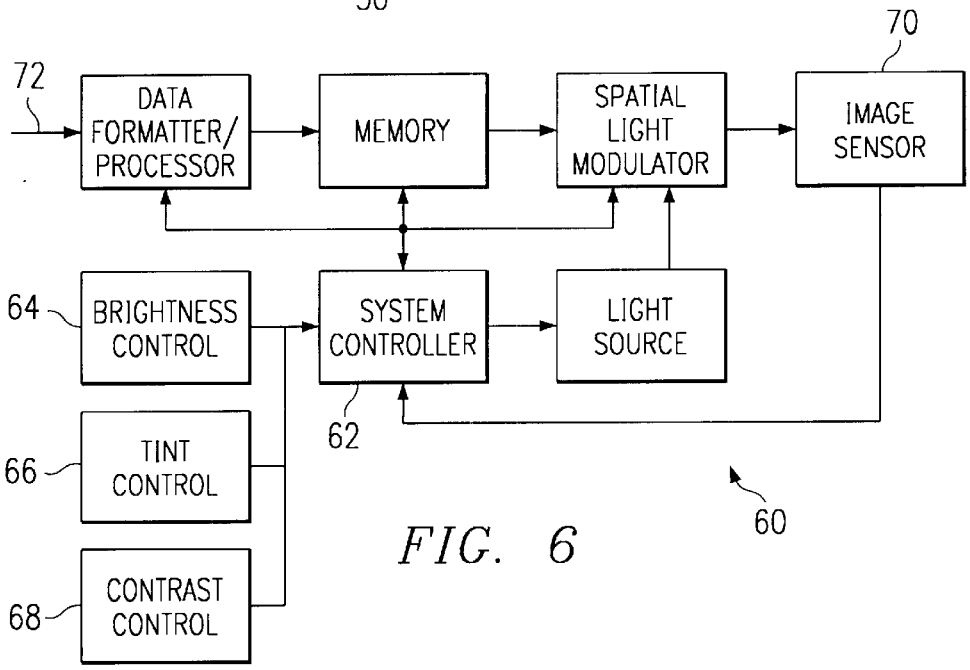
FIG. 6 is a schematic view of a display system according to the present invention.

In the previous discussion, the viewer adjusted the brightness, tint, and contrast of the image. An alternative is to allow the display system to automatically adjust the image. FIG. 6 shows a display system 60 that may be adjusted by either the viewer or the system controller 62. The viewer adjusts the image using the brightness control 64, tint control 66, and contrast control 68. The system can determine when to adjust the image characteristics either by monitoring the image with the image sensor 70 or by processing the input data stream 72. Color and contrast information may also be obtained for feedback to the system controller. The image sensor 70 may also be used to monitor ambient light to aid in determining the proper brightness level.

Thus, although there has been disclosed to this point a particular embodiment for a brightness and contrast control for a digital pulse-width modulated display system, it is not intended that such specific references be considered as limitations upon the scope of this invention except in-so-far as set forth in the following claims. Furthermore, having described the invention in connection with certain specific embodiments thereof, it is to be understood that further modifications may now suggest themselves to those skilled in the art, it is intended to cover all such modifications as fall within the scope of the appended claims.

What is claimed is:

1. A method of adjusting the intensity of a pulse-width modulated digital display pixel comprising:

representing said pixel with an intensity word having at least two bits;

dividing a pixel-display period into at least one bit display sub-period for each of said at least two bits and at least one blanking period, wherein the duration of all said bit display sub-periods for a given bit is representative of said bit's binary weight;

sequentially displaying each of said at least two bits during said bit display sub-period; and altering the intensity of said pixel by changing at least one of said blanking periods to a bit set period.

2. A digital display system comprising:

a digital display device for receiving a series of binary image data words and displaying an image representative of said data words, each said image data word comprised of at least two bits, each said bit in said image data words displayed sequentially for a display duration representative of the weight of said bit;

at least one input image modification signal representing a desired image contrast; and a display system controller, said system controller oppositely altering the display duration of at least two said bits based on said image modification signal.

3. The display system of claim 2 wherein said image modification signal is generated by a viewer.

4. The display system of claim 2 wherein said image modification signal is generated by an image sensor.

5. The method of claim 2 wherein said display duration of a first of said at least two bits is decreased while said display duration of a more significant of said at least two bits is increased.

6. The method of claim 2 wherein said display duration of a first of said at least two bits is increased while said display duration of a more significant of said at least two bits is decreased.

7. A method of adjusting the contrast of a pulse-width modulated digital pixel comprising:

representing said pixel with a binary-weighted intensity word having at least two bits;

dividing a pixel-display period into at least one bit display sub-period for each of said at least two bits, wherein the total period of all said bit display sub-periods for a given bit is a duration representative of said bit's binary weight;

sequentially displaying each of said at least two bits during said bit display sub-periods; and oppositely adjusting said bit display duration of at least two of said bits.

8. The method of claim 7 wherein said bit display duration of a first of said at least two bits is decreased while said bit display duration of a more significant of said at least two bits is increased.

9. The method of claim 7 wherein said bit display duration of a first of said at least two bits is increased while said bit display duration of a more significant of said at least two bits is decreased.

* * * * *